US005308309A

United States Patent [19]

Morris

[11] Patent Number: 5,308,309

[45] Date of Patent: May 3, 1994

[54] SECURING SYSTEM FOR CENTRIFUGE CHAMBER

[75] Inventor: Livingston B. Morris, Devon, Pa.

[73] Assignee: Therakos, Inc., West Chester, Pa.

[21] Appl. No.: 996,298

[22] Filed: Dec. 23, 1992

[51] Int. Cl.[5] ..... B04B 9/00

[52] U.S. Cl. ..... 494/85; 494/84

[58] Field of Search ..... 494/84, 60, 44, 85; 604/6

[56] References Cited

U.S. PATENT DOCUMENTS

| | | | |
|---|---|---|---|
| 4,101,070 | 7/1978 | Hoare | 494/84 |
| 4,718,888 | 1/1988 | Darnell | 494/84 |
| 4,753,630 | 6/1988 | Romanauskas | 494/84 |

*Primary Examiner*—Robert W. Jenkins

*Attorney, Agent, or Firm*—Joel R. Petrow

[57] ABSTRACT

An improved apparatus for automatically retaining a removable chamber during operation, in a system for separating and irradiating multi-component fluids. A clamp arm that having two ends is provided: the first acts as a securing means, the second contains the clamp arm center of mass. The clamp arm is pivoted on the rotating chuck near the interface of the rotating chuck interior and the removable chamber exterior. The pivot allows for rotation of the clamp arm about the pivot, the pivot being located between the first end with the securing means and the second end containing the center of mass. When the chuck is rotating, the end of the clamp arm containing the center of mass rotates outward, causing the clamp arm securing means to pivot above the removable chamber thereby securing it in place.

5 Claims, 4 Drawing Sheets

SECURING SYSTEM FOR CENTRIFUGE CHAMBER

BACKGROUND OF THE INVENTION

This invention relates to an improvement in securing or chucking, in a system for separating and irradiating multi-component fluids and, in particular, to the use of such systems in the field of treating cells with photoactivatable compounds by radiation, which activates the compounds to effect cellular change.

Numerous human disease states of the body respond favorably to the treatment of selected bodily fluid components, such as those found in blood, by visible or ultraviolet light irradiation Such treatment may be effective to eliminate immunogenicity in cells, inactive or kill selected cells, inactivate viruses or bacteria, or activate desirable immune responses. Certain forms of treatment with light irradiation may be effective without the introduction of outside agents or compounds, while others may involve the introduction of specific agents or catalysts. Among the latter treatment techniques is the use of photoactivatable agents to regulate the population of leukocytes. It is well-known that a number of human disease states may be characterized by the over production of certain types of leukocytes, including lymphocytes, in comparison to other populations of cells which normally comprise whole blood. Excessive or abnormal lymphocyte populations result in numerous adverse effects in patients including the functional impairment of bodily organs, leukocyte mediated autoimmune diseases and leukemia related disorders many of which often ultimately result in fatality.

U.S. Pat. Nos. 4,321,919; 4,398,906; 4,428,744 and 4,464,166 to Edelson describe methods for treating blood whereby the operation or viability of certain cellular population may be moderated thereby providing relief for these patients. In general, the methods comprise treating the blood with a dissolved photactivatable drug, such as psoralen, which is capable of forming photoaducts with DNA in the presence of ultraviolet (U.V.) radiation. It is believed that covalent bonding results between the psoralen and the lymphocyte nucleic acid thereby effecting metabolic inhibition of the treated cells. Following extracorporeal irradiation, the cells are returned to the patient where they are thought to be cleared by natural processes but at an accelerated pace, believed attributable to disruption of membrane integrity, alteration of DNA within the cell, or like conditions often associated with substantial loss of cellular effectiveness or viability.

Although a number of photoactivatable compounds in the psoralen class are known, 8-methoxy psoralen is presently the compound of choice. An effective radiation for this compound, and for many psoralens in general, is the ultraviolet spectrum in the range of approximately 320 to 400 nanometers, alternatively referred to as the uvA spectrum. As the development of photoactivatable compounds proceeds, it may be expected that changes in the preferred activation radiation spectrum may occur. For instance, it may be preferable to treat some disease states with light in the ultraviolet spectrum of 280 to 320 nanometers, referred to as the uvB spectrum.

An apparatus for carrying out the above referenced Edelson method of treatment is described in detail in U.S. Pat. No. 4,921,473 to Lee et al. This document describes in detail a multi-component bodily fluid separating and irradiation system which includes a housing, a rotatable chuck located within the housing, a removable separation/irradiation chamber suitable for mounting in the rotatable chuck which has at least one passage way for the passing of a multi-component bodily fluid into and out of the rotatable chamber, and a source radiant energy connected to the housing and located near the separation irradiation chamber so as to allow transmission of radiant energy to the interior of the chamber that contains the multi-component bodily fluid.

While the foregoing system and method has met clinical and regulatory standards, it is desirable to provide the system with greater operational efficiency.

In particular, the current system for retaining the removable separation/irradiation chamber utilizes either screws, which are subject to over- or under-tightening with each use, along with O-rings for gripping when the screws are tightened. In addition to problems with the tightening of the screws, the O-rings present an additional problem that make it difficult to insert or release the centrifuge bowl unless the O-rings are regularly cleaned and frequently greased.

Another method for retaining the bowl is the use of wedges. Wedges however, can be misplaced and lost and also present the possibility of being improperly inserted.

Finally, vacuum systems are available to retain the removable chamber while it is being rotated during use. Although vacuum systems are convenient, they are fairly complicated requiring pumps and rotating seals. In addition, this type of system has components that can be contaminated by a spill and is difficult to clean.

It is an object therefore, of the present invention to provide a system for automatically securing a removable chamber inside a rotating chuck that does not require operator adjustment.

It is another object of the present invention to provide such a securing system that does not have parts that can be misplaced and lost.

It is another object of the present invention to provide such a securing system that is simple, does not require additional active mechanical components and does not require cleaning or maintenance.

SUMMARY OF THE INVENTION

The above objectives are achieved by an improvement in the above system by an apparatus that automatically retains the removable chamber during operation by providing a clamp arm that has two ends. The first acts as a securing means, the second contains the clamp arm center of mass. The clamp arm is pivoted on the rotating chuck near the interface of the rotating chuck interior and the removable chamber exterior. The pivot allows for rotation of the clamp arm about the pivot, the pivot being located between the first end with the securing means and the second end containing the center of mass. When the chuck is rotating, the end of the clamp arm containing the center of mass rotates outward, causing the clamp arm securing means to pivot above the removable chamber thereby securing it in place.

In the preferred embodiment, a plurality of these are used, preferably three. The preferred embodiment contains on the clamp arm end containing the securing means, a bevelled end so that the clamp arm swings out of the way upon insertion or removal of the chamber. The preferred embodiment also includes a stop pin which prevents the end of the clamp arm containing the center of mass from rotating under the rim of the chamber and interfering with its insertion.

DETAIL DESCRIPTION OF THE PREFERRED EMBODIMENT

Figure 1:
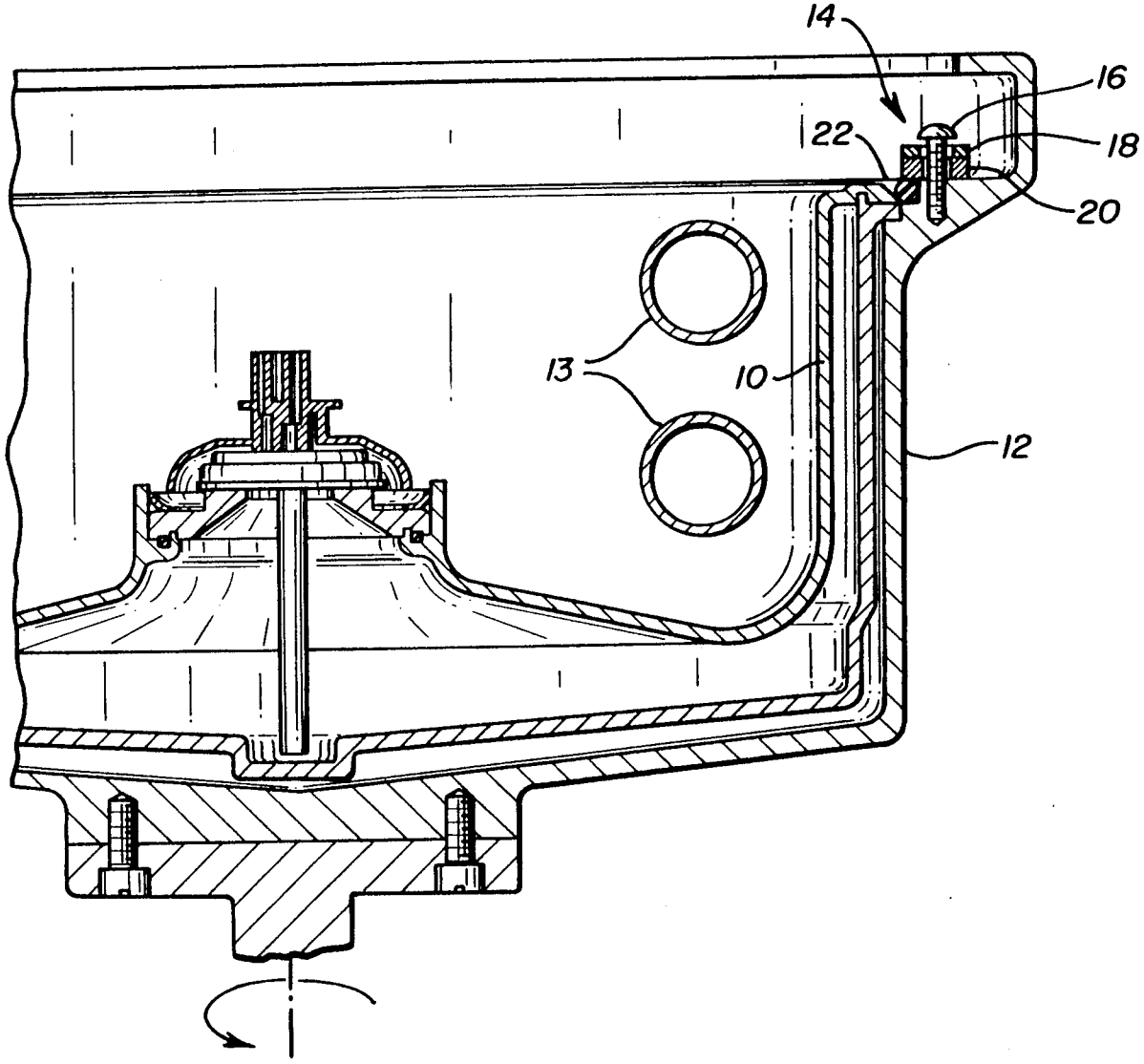
FIG-1 PRIOR ART
FIG. 1 is a cross sectional view of a prior art means for securing the removable chamber into the rotatable chuck of the separating and irradiating system.

Referring to FIG. 1, there is shown a multicomponent bodily fluid separating and irradiation apparatus employing one of the prior art systems for securing the chamber 10 within chuck 12 and showing a source of radiant energy 13 located near the separation irradiation chamber.

This prior art securing system 14 is comprised of screw 16 which is locked into the chuck 12. This screw passes through nut 18 which has matching mating threads for the screw as well as passing through clamp ring 20 which is unthreaded and does not interact with the screw.

O-ring 22 is compressed by clamp ring 20 when nut 18 is tightened down on clamp ring 20. Nut 18 is free to turn between the top of screw 16 and a tightened position fully down on clamp ring 20 in about 1 to 1½ turns.

In FIG. 1, nut 18 is shown in the fully clamped position compressing O-ring 22 upon the flange of chamber 10. In this way, three or four of these systems are used to secure chamber 10 in chuck 12.

Figure 2:
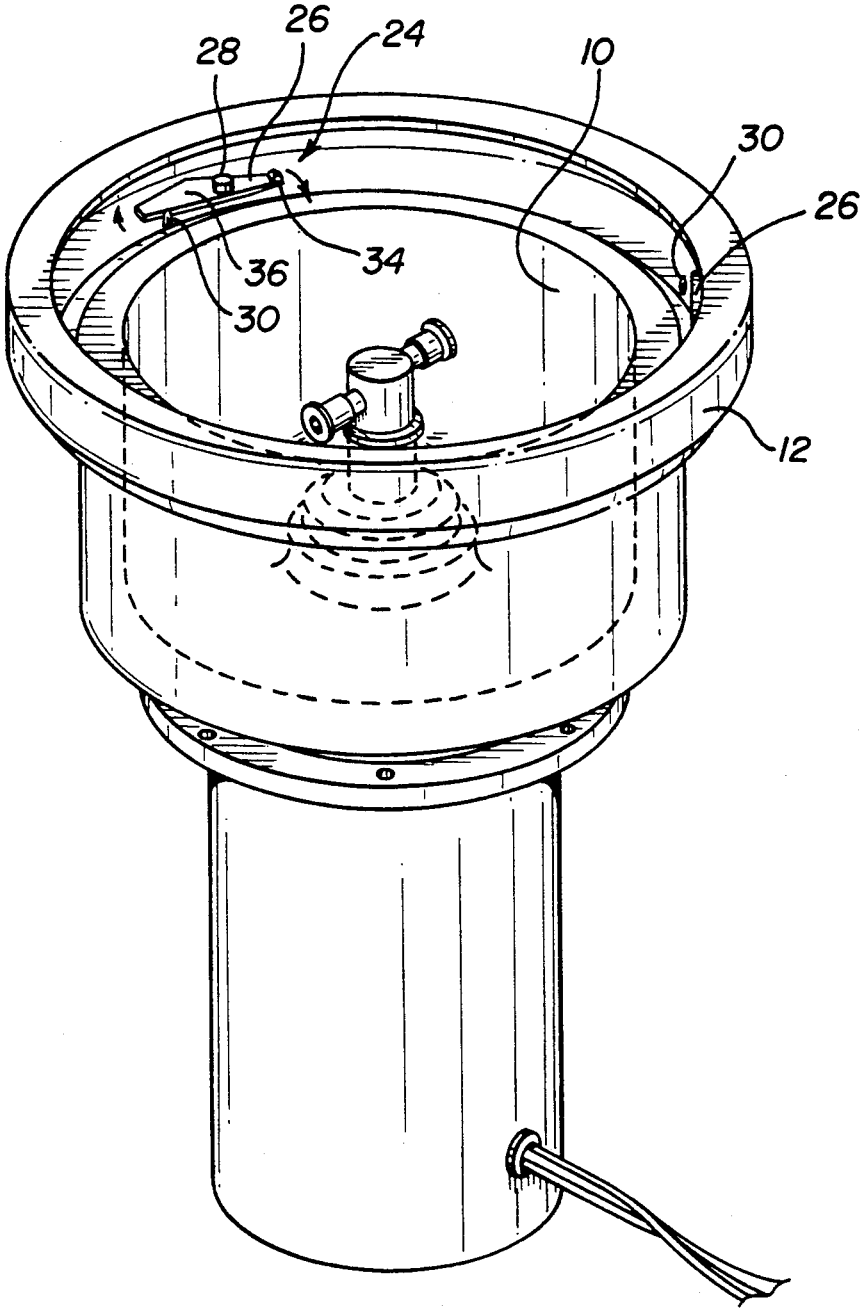
FIG. 2 is an isometric view showing the rotatable chuck and removable chamber as well as the securing system of the present invention.

Referring now to FIG. 2, the chuck 12 and chamber 10 are shown in isolation without the remainder of the blood separation and irradiation system. Also shown is the improved retaining system 24 of the present invention. This retaining system comprises clamp arm 26 which is free to rotate at least partially about pivot 28. Pivot 28 is constructed of stainless steal shoulder screws. Rotation of the clamp arm 26 is limited by stop pin 30.

Figure 3:
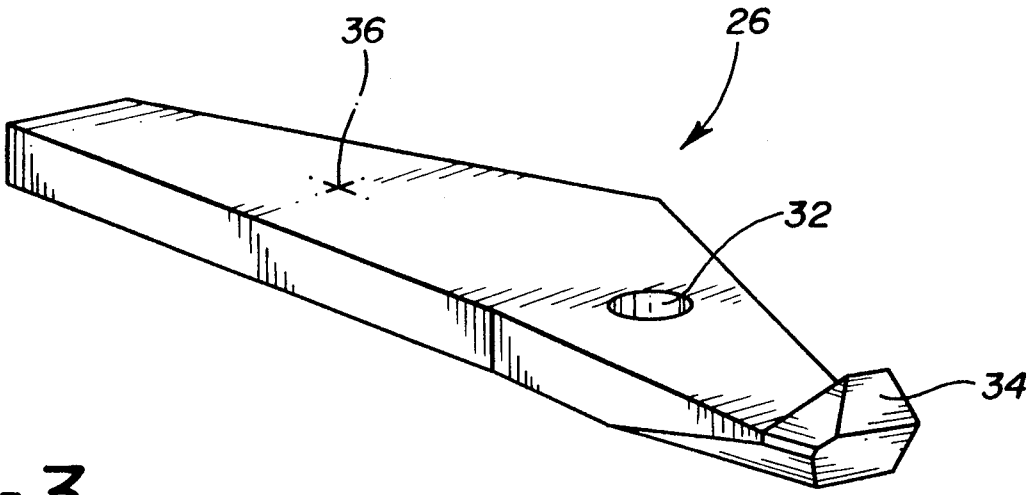
FIG. 3 is an isometric view of a clamp arm which forms one of the elements of the present invention.

Referring now to FIG. 3, clamp arm 26 is shown in greater detail. Clamp arm 26 is comprised of pivot point 32 wherein pivot 28 mates. Clamp arm 26 is comprised of two portions: a first portion having a securing means 34 and a second portion containing the clamp arm center of mass 36.

Referring back now to FIG. 2, in operation chuck 12 rotates in the direction indicated by the arrow, although this is merely a matter of design choice and the device of the present invention will work equally well with rotation counter to that shown. This rotation causes the center of mass 36 to move away from the central axis of the chamber chuck combination, causing clamp arm 26 to rotate about pivot 28 in the direction of the arrows shown at either end of the clamp arm. This causes securing means 34 to move above chamber 10. Again, this direction of rotation of the clamp arm is a design choice, and the present invention would work equally well with the clamp arm designed to rotate in the other direction.

Figure 4:
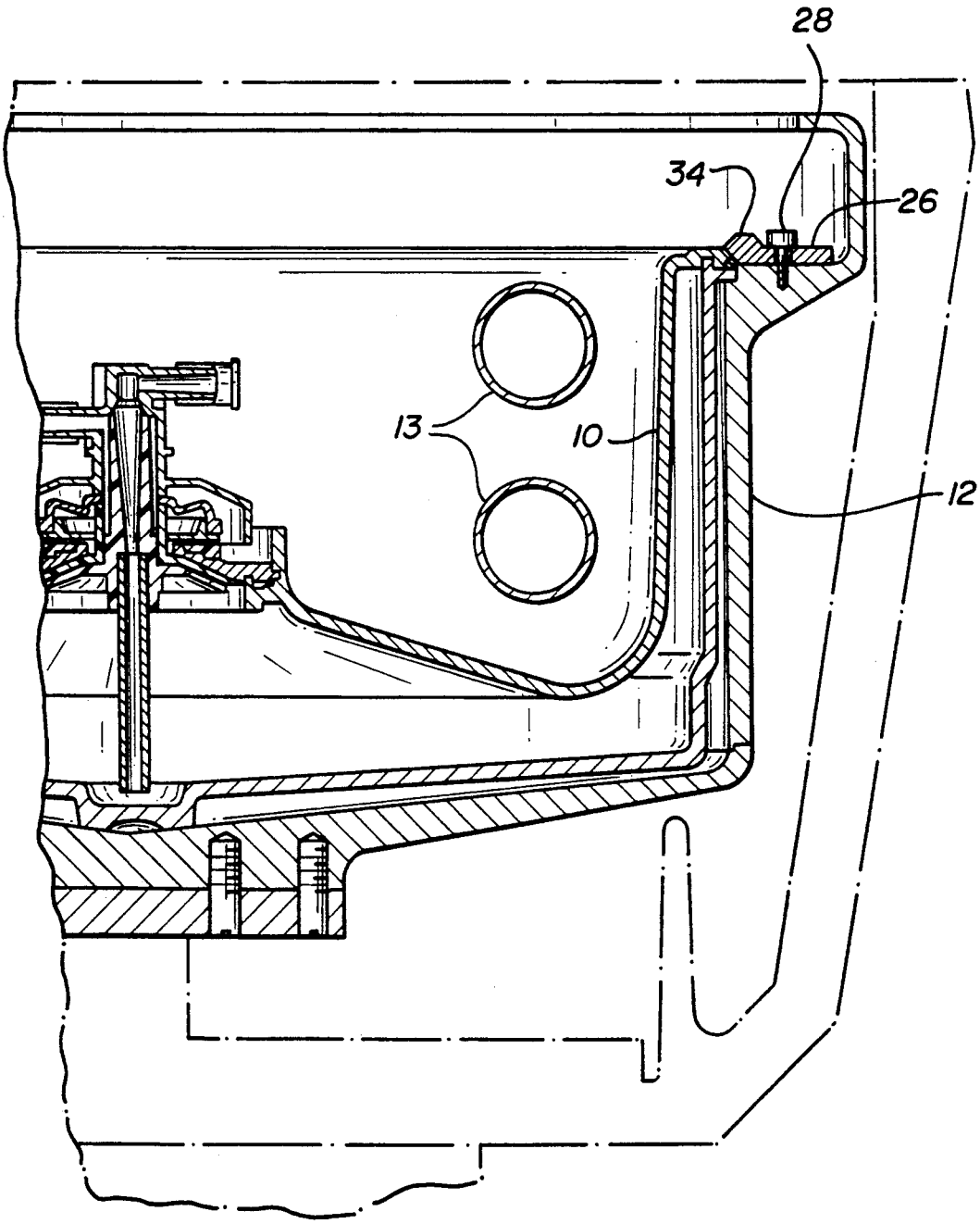
FIG. 4 is a cross sectional view of the present invention showing the improved chamber securing apparatus as it would be positioned during operational rotation of the chuck and chamber.

Referring now to FIG. 4, there is shown the separation irradiation system with the apparatus of the present invention taking the position it assumes during operational rotation of the chuck 12 and showing a source of radiant energy 13 located near the separation irradiation chamber. As is readily apparent from the Figure, securing means 34 with its chamfered edge rotates over the ledge of chuck 12 and above a portion of chamber 10. In this way, chamber 10 is secured within chuck 12 during operational rotation of the device.

As is also apparent from the Figure, the bevelled portions of securing means 34, preferably at angles of 45°, allows chamber 10 to be removed and inserted when chuck 12 is stationary by translating upward or downward force on the chamber during removal or insertion into translational force rotating clamp arm 26 out of the way of chamber 12.

As is similarly apparent from FIG. 2, stop pin 30 located on chuck 12 is positioned to prevent the second portion of clamp arm 26 containing center of mass 36 from inadvertently becoming positioned under the edge of the chamber 10 when the chuck 12 is not rotating, preventing insertion of the chamber. The use of a stop pin is preferable to attempting to implement a bevel on this end because of the end's width and thinness.

In lieu of stop pin 30 preventing such rotation and the bevels of securing means 34 allowing ready insertion and removal of the chamber, a bias means may be used, such as a spring, to provide a small force causing the clamp arm 26 to return to a desired stable position when the unit is not in operation. An embodiment implementing by conventional means a bias means such as a spring, and elimination of the stop pin is readily apparent to one working in the mechanical arts. This approach, however, has the disadvantages of using small parts that can be loosened and lost and are difficult to clean, and is therfore not preferred.

In operation, two or more of the above described apparatus (typically three) are used to hold the chamber in place during operation. It has been found that gravity alone is sufficient to hold the chamber in place until the chuck begins to turn when centrifugal force acts on the clamp arm to rotate the arm about pivot 28 in the desired direction.

With the securing means 34 properly designed with the bevels, it has been found that the bowl can simply be dropped into the chuck where it will settle into the corresponding seat of the chuck, so that the clamp arm can grip the chamber when rotation starts.

When the above improved securing system is installed in a separation and irradiation system for blood such as that described in U.S. Pat. No. 4,921,473, the following results were obtained. As chuck 12 spins, the center of gravity of the clamp arm 26 moves radially outward, rotating the arm to bring the bevelled surface of securing means 34 to bear on chamber 10. The centrifugal force at the operating angular velocity of 1340 revolutions per minute was found to be 11.8 pounds. The downward force at the bearing surface was found to be 6.32 pounds.

Because of the bevel on the underside of securing means 34, the chamber 10 can be lifted directly out of chuck 12 because the bevel angels at 45° are sufficient to prevent jamming the arm against the rim of the bowl. Specifically, it was calculated that if there were no friction, the force to remove the chamber should be approximately 19 pounds. Under actual conditions, it was measured that the chamber could be removed with a direct upward pull of 42 pounds, deflecting the clamp arms and freeing the chamber from the chuck.

As a test of the reliability of this invention, the system was run with a 7.22 ounce-inch unbalance with a full fluid charge of 250 cc for 3½ hours at 1340 revolutions per minute. This period of operation was completed successfully without any problems or unexpected occurrences.

I claim:

1. An improved system for separating and irradiating multi-component bodily fluid, said system including a housing, a rotatable chuck located within said housing, a removable separation irradiation. chamber suitable for mounting in said rotatable chuck and having at least one passageway for the passing of the multicomponent bodily fluid, and a source of radiant energy located proximate said separation/irradiation chamber so as to allow transmission of radiant energy to the interior of said chamber, wherein the improvement in said system is an apparatus for automatically retaining said removable centrifuge during operation, said apparatus comprising:

a clamp arm having two portions, a first portion securing means and a second portion containing the clamp arm center of mass, a pivot for allowing at least partial rotation of said clamp arm about the pivot, said pivot located between said first portion having a securing means and said second portion containing the clamp arm center of mass, said pivot attaching said clamp arm to said rotatable chuck at a location where rotation of the second clamp arm portion about the pivot in a direction away from the chuckchamber central axis causes said clamp arm first portion securing means to take a position above said chamber, preventing its removal.

2. The apparatus of claim 1 wherein said clamp arm first portion securing means comprises a beveled end, said bevel angle causing said clamp arm to rotate about said pivot in a direction away from the chuck chamber central axis upon insertion or removal of said chamber, preventing operation of the securing means.

3. The apparatus of claim 1 further comprising a stop pin located on the said rotatable chuck at a location where rotation of the second clamp arm portion about the pivot in a direction toward the chuck chamber central axis is limited to prevent said clamp arm second portion from taking a position below the rim of said chamber.

4. The apparatus of claim 3 further comprising a bias means to prevent said first portion securing means from taking a position above said chamber when said chuck is not rotating.

5. The apparatus of claim 4 wherein said bias means is a spring.

* * * * *